United States Patent [19]

Mathiesen et al.

[11] Patent Number: 4,496,367

[45] Date of Patent: Jan. 29, 1985

[54] PUMPABLE AQUEOUS SLURRY OF A SOLID FUEL AND A PROCESS FOR THE PRODUCTION THEREOF

[75] Inventors: Mait M. Mathiesen, Arild; Lars I. Gillberg, Lund; Karl M. E. Hellsten, Ödsmål; Gunvor B. T. Karlsson, Stenungsund, all of Sweden

[73] Assignees: AB Carbogel, Helsingborg; Berol Kemi AB, Stenungsund, both of Sweden

[21] Appl. No.: 492,195

[22] Filed: May 6, 1983

[30] Foreign Application Priority Data

May 7, 1982 [SE] Sweden ..... 8202878

[51] Int. Cl.[3] ..... C10L 1/32

[52] U.S. Cl. ..... 44/51; 44/77; 252/351; 406/47; 406/49; 406/197

[58] Field of Search ..... 44/51, 77; 252/351; 406/47, 49, 195, 197

[56] References Cited

U.S. PATENT DOCUMENTS

| | | | |
|---|---|---|---|
| 2,346,151 | 4/1944 | Burk | 44/51 X |
| 2,359,325 | 10/1944 | McConnell | 44/51 X |
| 3,012,826 | 12/1961 | Puff et al. | 406/47 |
| 3,168,350 | 2/1965 | Phinney et al. | 44/51 |
| 3,254,682 | 8/1970 | Booth | 302/66 |
| 3,762,887 | 10/1973 | Clancey | 44/51 X |
| 4,076,505 | 2/1978 | Dessau | 44/1 R |
| 4,094,810 | 6/1978 | Thomas | 44/51 X |
| 4,162,044 | 7/1979 | Manfroy | 241/16 |
| 4,162,045 | 7/1979 | Katzer | 241/16 |
| 4,217,109 | 8/1980 | Siwersson | 44/51 |
| 4,242,098 | 12/1980 | Braun et al. | 44/51 |
| 4,282,006 | 8/1981 | Funk | 44/51 |
| 4,302,212 | 11/1981 | Yamomura et al. | 44/51 |
| 4,358,293 | 11/1982 | Mark | 44/51 |

FOREIGN PATENT DOCUMENTS

| | | |
|---|---|---|
| 0077909 | 5/1983 | European Pat. Off. . |
| 1644942 | 8/1977 | Fed. Rep. of Germany . |
| 1308112 | 9/1962 | France . |
| WO83/0005-00 | 2/1983 | PCT Int'l Appl. . |

*Primary Examiner*—William R. Dixon, Jr.
*Assistant Examiner*—Margaret B. Medley
*Attorney, Agent, or Firm*—Gordon W. Hueschen

[57] ABSTRACT

A pumpable aqueous slurry of a solid fuel in the form of a pulverized, carbonaceous material and a process for the production of such slurry are described. The aqueous slurry comprises a component which consists of coarse grains of carbonaceous material having a particle size of up to 25 mm, and a further component which consists of a carrier liquid in which the coarse-grained carbonaceous material is suspended. The carrier liquid proper has a solids content of 65–90% by weight and consists of water and pulverized, carbonaceous material having a particle size of at most 0.5 mm, preferably at most 350 μm, and 0.02–2% by weight of at least one additive including a water-soluble surface active compound which consists of an alkylene oxide adduct having a hydrophobic part and a hydrophilic part, said hydrophilic part consisting of a polyalkylene oxide chain, preferably a polyethylene oxide chain, having a length of 40–200 alkylene oxide units. The pumpable aqueous slurry is produced by first preparing the carrier liquid and then adding to said liquid 20–40% of the coarse-grained, carbonaceous material, based upon the total weight of the aqueous slurry. The aqueous slurry is intended primarily for pumping in pipelines.

9 Claims, No Drawings

PUMPABLE AQUEOUS SLURRY OF A SOLID FUEL AND A PROCESS FOR THE PRODUCTION THEREOF

The present invention relates to a pumpable aqueous slurry of a solid fuel in the form of a pulverized, carbonaceous powder, and to a process for the production of such slurry.

The basic problem in the transport of solid fuel/liquid mixtures, for instance the transport in slurry tankers and, above all, in pipelines, resides in the difficulty of producing easily pumpable, highly concentrated mixtures.

Prior art technique, such as disclosed by U.S. Pat. Nos. 3,762,887, 3,073,652, 3,168,350, 3,524,682, 3,842,013 and 4,282,006, and applied technology (for example the Black Mesa pipeline in Arizona/Nevada) have been unable to obviate the difficulties referred to in the following.

The conventional applied technology utilizes a mixture of rather coarse coal and water which during transport is kept by turbulence in so-called bouncing suspension. As a result, the pumping cost will be relatively high, to which must be added three crucial shortcomings, namely:

(1) The mixture is unstable in that the water and the coal are readily separated, which makes it difficult to pump the mixture uphill.

(2) Large amounts of water are required for transporting the coal in a 50% mixture with the water, which may lead to environmental pollution when the coal must be transported from regions where water is scarce.

(3) When, at the end of the pipeline, the mixture can neither be transported further nor used without extensive and costly dewatering, difficulties arise in disposing of the water chemically polluted by the coal.

Such improvements as have been suggested, primarily in U.S. Pat. No. 4,282,006, have aimed at increasing the solids content of the mixtures by using finer particle sizes and controlled particle size distributions as well as certain chemical additives to reduce viscosity and increase pumpability. Nevertheless, these compositions suffer from considerable disadvantages, primarily in respect of the rheological characteristics. The compositions have a so-called yield-pseudoplastic character, which means that a certain shear force is required to put the mixture in motion from standstill. A temporary stop in the pumping of such compositions will entail devastating difficulties when pumping is restarted.

The present invention has for its object to obviate the above-mentioned shortcomings of known technology by providing a pumpable aqueous slurry of a solid fuel, said slurry containing, in addition to coarse grains of a carbonaceous material, a special carrier liquid for the coarse-grained, carbonaceous material. Basically, this carrier liquid consists of a highly concentrated coal slurry having a high content of finely pulverized, carbonaceous material and a low water content. By combining the coarse-grained carbonaceous material with the novel carrier liquid, a number of advantages are obtained.

The solids content of the slurry which substantially consists of fuel in the form of carbonaceous material, amounts to at least 65% by weight, which means that dewatering is not needed after transport, and that the specific transport cost will be low. Furthermore, the aqueous slurry has a low apparent viscosity, which gives a low pumping cost.

The aqueous slurry exhibits Newtonian rheology, i.e. the pumping resistance is practically independent of the shear rate.

Furthermore, the aqueous slurry is stable, which means that the solids part does not tend to separate from the liquid, and consequently the aqueous slurry is well suited for pumping uphill.

The solid substance of the carrier liquid preferably is a purified fraction of carbonaceous material, whereby the specific transport cost is further reduced and the slurry will be even more suitable as a fuel without dewatering after transport.

In the aqueous suspension according to this invention, the coarse-grained carbonaceous material is suspended in an apparently heavier liquid, that is the carrier liquid according to the invention, and can therefore be transported with a lesser degree of turbulence and with far less water than is the case when the carrier liquid consists of water.

The characteristic features of the invention will appear from the appended claims.

The carbonaceous material which in the invention is present both in the carrier liquid and in the coarse-grained fraction suspended therein, is selected from different types of carbonaceous materials, such as bituminous, anthracitic, sub-bituminous and lignitic coal, charcoal and petroleum coke.

The coarse-grained carbonaceous material suspended in the carrier liquid consists of coarse grains having a particle size of up to 25 mm. Without first screening the coarse-grained material, it is difficult to prevent a certain minor proportion of fine-grained material from being carried along, but generally the coarse-grained carbonaceous material has a minimum particle size of at least 1 mm. The fraction of the coarse-grained carbonaceous material in the aqueous slurry according to the invention may, in and per se, amount to but a few percent by weight but normally constitutes an essential part of the aqueous slurry and preferably amounts to 20–40% by weight, based upon the total weight of the aqueous slurry.

In addition to the above-mentioned coarse-grained carbonaceous material, the pumpable aqueous slurry according to the present invention also comprises a novel and specific carrier liquid which will be described in more detail below.

First, however, it should be mentioned in the context that it is previously known to produce slurries of pulverized solid fuels and to stabilize these slurries in a greater or less degree by means of various additives. An example of prior-art technique is U.S. Pat. No. 4,217,109 which discloses a coal/water slurry containing a dispersant which, by selective adsorption, causes coal particles and particles of other material to be charged differently, whereby purification of the coal and also stabilization of the suspension is facilitated. The dispersant according to the U.S. patent specification is selected among polyelectrolytes or polyphosphates.

Moreover, it is already known from the published PCT application PCT/US80/01419 to produce a highly concentrated slurry of coal in water by controlling the particle size distribution of the coal in a specific manner and to add surface active chemicals imparting a specific surface charge to the coal particles. The surface active chemicals employed are commercially available dispersants. The characteristics of the slurry are highly dependent upon a combination of an exact particle size distribution and the surface charge of the individual particles, which is achieved by adding exact amounts of dispersant. In actual practice, however, it is extremely difficult to reproducibly achieve, on a commercial scale, the required exact particle size distribution, or to maintain the characteristics of the slurry at an increasing ionic contamination of the slurry due to, for example, corrosion of the equipment or leaching of the coal.

In addition, it is already known from French Patent Specification No. 1,308,112 to cause a viscosity reduction of low-concentrated coal suspensions by using an alkylene oxide adduct in which the hydrophilic part preferably consists of 5–35 ethylene oxide units.

British Patent Specification No. 1,429,934 concerns a process of dispersing a particulate material in a liquid by means of a block copolymer made up of blocks which are, respectively, soluble and insoluble in the liquid. Poly(t-butyl styrene) is mentioned as an example of a soluble block. The particulate material is highly fine-grained and, preferably, has a particle size of from 50 Å to 10 μm. One example of particulate material is carbon black.

U.S. Pat. No. 4,358,293, published on Nov. 9, 1982 and the corresponding EPC application No. 82300448.6, publication No. 0 057 576, published on Aug. 11, 1982, disclose aqueous coal dispersions wherein nonionic surfactants with at least 100 repeating ethylene oxide units are employed as dispersants.

The carrier liquid of the present invention distinguishes over this prior art technology in that it consists of a highly concentrated aqueous slurry of pulverized carbonaceous material, i.e. an aqueous slurry having a solids content of 65–90% by weight, preferably 70–80% by weight, the carrier liquid incorporating a special additive in the form of an aqueous surface active compound which is an alkylene oxide adduct having a hydrophobic part and a hydrophilic part, said hydrophilic part containing at least one polyalkylene oxide chain having a length of 40–200 alkylene oxide units.

By the term "surface active" is here meant that a 0.1% solution of the alkylene oxide adduct in water having a temperature of 20° C. has a surface tension below 50 dynes/cm, measured according to the Du Noüy ring method. Alkylene oxide adducts having a surface tension of 40–49 dynes/cm are especially suitable.

A surface active alkylene oxide adduct made up of a hydrophobic part and a hydrophilic part with the above-mentioned composition makes it possible to achieve a steric stabilization of the carrier liquid according to the invention in that the hydrophobic part of the alkylene oxide adduct is adsorbed to the surfaces of the fuel particles, while the hydrophilic part, the polyalkylene oxide chain, of the alkylene oxide adduct binds a water layer to the surface of the fuel particle. If the surface of each particle is covered by adsorbed alkylene oxide adduct, each fuel particle in the carrier liquid will be surrounded by such a bound water layer or casing. This water layer around each fuel particle reduces the internal friction in the carrier liquid so that the particles can execute a sliding movement past one another which remains unaffected by the attractive forces between the particles. Furthermore, the steric stabilization according to the present invention is insensitive to variations in the level of concentration of different salts in the aqueous slurry.

It must be emphasized that the carrier liquid, as has been mentioned before, consists of a highly concentrated aqueous slurry, i.e. a slurry having a solids content of at least 65–90% by weight, preferably 70–80% by weight. This means that the water constitutes but a minor part of the slurry and is present in a content below 35% by weight, preferably 20–30% by weight. To the inventors' knowledge, it is not previously known to produce aqueous slurries of carbonaceous material having a solids content of above 65% by weight, while maintaining the pumpability and stability of the slurry.

However, it has now been surprisingly found that these problems can be eliminated by adding a particularly water-soluble surface active compound which consists of an alkylene oxide adduct having a hydrophobic part and a hydrophilic part, said surface active compound being characterized in that the hydrophilic part consists of at least one polyalkylene oxide chain having a length of at least 40 alkylene oxide units, i.e. the hydrophilic part consists of at least one hydrophilic chain having a given minimum length. It has been found that this minimum length of the hydrophilic chain is an indispensable condition for achieving a stable and low-viscous, i.e. pumpable carrier liquid at a solids content exceeding 65% by weight. Actually, there is no upper limit for the length of the hydrophilic chain, but for practical and economic reasons it is preferred, in the context of this invention, to limit the chain length to 200 alkylene oxide units at the most. The best results of the present invention have been obtained with alkylene oxide adducts containing 50–150 alkylene oxide units in the hydrophilic chain. Furthermore, it is especially preferred that the alkylene oxide units consist of ethylene oxide units.

The inventors have found that the stability of the carrier liquid, i.e. its resistance to separation of the water from the solids during storage and transport of the carrier liquid, including vibration of the carrier liquid, reaches a maximum within the preferred range of alkylene oxide units in the hydrophilic chain. Thus, if the hydrophilic chain is too short (the number of alkylene oxide units is below 40), separation and sedimentation will occur if the slurry has been subjected to vibration for a few days. It has also been found that the stability of the carrier liquid is reduced as the length of the hydrophilic chain is increased beyond 200 or even 150 alkylene oxide units.

In addition to the hydrophilic part as described above, the surface active compound according to the invention also comprises a hydrophobic part, which is adapted to adsorption onto the surface of the pulverized carbonaceous material.

The compounds according to the present invention can be obtained by adding alkylene oxide having 2–4 carbon atoms in such a manner to an organic compound made up of hydrogen and carbon and, optionally, oxygen or sulphur and having 1–20 hydrogens reactive with ethylene oxide, propylene oxide or butylene oxide, that a nonionic surface active compound with an alkylene oxide chain having at least 40 alkylene oxide units is obtained. Compounds of this type may be expressed by the general formula $$R[Y(A)_nH]_m \qquad \text{I}$$

in which R is a residue of the organic compound, Y is oxygen or sulphur, A is an alkylene oxide group having 2–4 carbon atoms, n is an integer of 40–200, preferably 50–150, and m is an integer of 1–20, wherein at least 40 repeating alkylene oxide units, e.g. ethylene oxide units, form a chain.

If R has been derived from a low-molecular compound or from a compound of insufficient hydrophobic character, it will be necessary to add propylene oxide and/or butylene oxide to form a block, thereby to obtain a sufficiently large hydrophobic residue in order to impart sufficient surface activity to the final compound.

Another possibility is to modify compound I by introducing a hydrophobic group, in which case it should be observed, however, that the new final compound must contain at least one polyalkylene glycol chain made up of at least 40 alkylene oxide groups.

The organic compound to which alkylene oxide is added, may consist of mono- or polyfunctional hydroxyl and/or carboxyl compounds containing 1–40 carbon atoms, or of oligomeric or polymeric compounds having several hydroxyl and/or carboxyl groups. Examples of suitable monofunctional hydroxyl and carboxyl compounds are methanol, ethanol, propanol, butanol, hexanol, cyclohexanol, acetic acid, propionic acid, butanoic acid, hexanoic acid and 2-ethyl hexanoic acid. Examples of polyfunctional hydroxyl and carboxyl compounds are glycerol, trimethylol propane, butylene glycol, butane triol, hexane triol, pentaerythritol, sorbitol, sorbitan, saccharides, such as saccharose, glucose, arabinose, fructose, mannose, dextrose, lactose and maltose, succinic acid, glutaric acid, adipic acid, sebacic acid, phthalic acid, isophthalic acid, dodecane dicarboxylic acid and resorcinol.

Especially preferred alkylene oxide adducts based upon polyfunctional compounds are the so-called block copolymers which are made up of blocks consisting of ethylene oxide, propylene oxide and, optionally, butylene oxide. The molar weight of the propylene oxide or, alternatively, the butylene oxide moiety or moieties should preferably lie within the range 1500–4000, while the polyethylene oxide moiety or moieties should preferably have a molar weight of 2000–10000.

Other examples of compounds comprised by formula I are alkoxylated sulphur compounds having the general formula $$R^3-S-(A)_nH \qquad \text{II}$$

in which $R^3$ represents a hydrocarbon group having 1–24 carbon atoms or, preferably, the group $(A)_nH$, each A represents an alkylene oxide group having 2–4 carbon atoms, and n=at least 40, preferably 50–200.

In the event that the organic compound is a carboxylic acid having 10–24 carbon atoms or an aromatic hydroxyl compound having 12–54 carbon atoms, the hydrophobic groups are sufficiently large to impart to the compound a sufficient surface activity, for which reason an increase of the hydrophobic part by adding propylene oxide and/or butylene oxide is not necessary. These compounds may be illustrated by the general formula $$RO(CH_2CH_2O)_nH \qquad \text{III}$$

in which R represents an aliphatic or acyl group having 10–24, preferably 14–24 carbon atoms or a substituted aryl group having in total 12–54, preferably 14–42 carbon atoms, and n is 40–200. Especially preferred are such compounds in which n is at least 40 but less than 100, or in which n is 40–200 in which latter case the ratio of ethylene oxide units to the number of carbon atoms in the group R is 3.5–6.0 when R is an aliphatic or acyl group and 3.0–5.5 when R is a substituted aryl group.

Examples of suitable organic compounds of this type are decyl alcohol, lauryl alcohol, myristyl alcohol, cetyl alcohol, stearyl alcohol, eicosyl alcohol, oleyl alcohol, cyclododecanol, cyclohexane decanol, octyl phenol, nonyl phenol, dodecyl phenol, hexadecyl phenol, dibutyl phenol, dioctylphenol, dinonyl phenol, didodecyl phenol, dihexadecyl phenol, trinonyl phenol, capric acid, lauric acid, myristic acid, palmitic acid, stearic acid, oleic acid, linoleic acid and arachidic acid.

To further illustrate the special surface active compound according to the invention, the following examples of useful compounds are given.

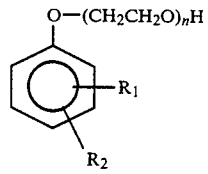

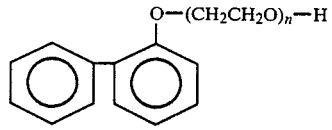

wherein $R_1$ designates an alkyl group, $R_2$ designates an alkyl group or hydrogen and n is either at least 40 but less than 100, suitably at least 50 but less than 100, and preferably 50–90, or n is 40–200, preferably 50–150, in which latter case the ratio of ethyleneoxy units to the number of carbon atoms in the substituted phenyl group is 3.0–5.5. Disubstituted compounds are particularly preferred and especially those in which $R_1$ and $R_2$ are nonyl groups.

Further examples of alkylene oxide adducts that may be used with the present invention are polyalkylphenol polymethylene or polyalkylnaphthalene polymethylene compounds in which some or all OH are alkoxylated with 40–200 alkylene oxide groups, preferably ethylene oxide groups. When all OH have been alkoxylated, the polyalkylphenol polymethylene compounds show the general formula IV:

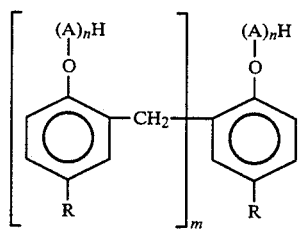

(IV)

in which

R=an alkyl group having 1–20 carbon atoms n=40–200 m=1–20

As will appear from the above, the dispersant used with the present invention normally is nonionic, i.e. it has no charge. In some cases, however, it may be suitable to add, besides to the nonionic agent, an ionic dispersant, the hydrophobic part of which exhibits, by means of electrostatic forces of attraction, enhanced adsorption to the fuel particles. Depending upon whether the surface of the carbonaceous fuel material exhibits negative or positive electric charges, such enhancement of the adsorption by means of electrostatic attraction can be achieved by making the surface active compound, more particularly its hydrophobic part, cationic or anionic.

The ionic surface active agent may, in principle, be freely selected from known ionic surface active compounds. Some of the most appropriate types of anionic compounds generally available are those of the following formulas:

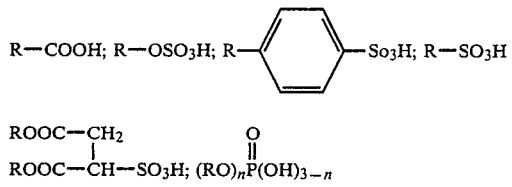

wherein R denotes a hydrophobic group with 8–22 carbon atoms and n is the integer 1 or 2; or a salt thereof with an alkali metal, an alkaline earth metal, an ammonium or an amine compound. Among the anionic surfactants especially alkylarylsulphonates of the following formula may be mentioned

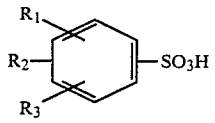

wherein $R_1$, $R_2$ and $R_3$ independently of each other denote an alkyl group with 1–18 carbon atoms or hydrogen, with the proviso that the total number of carbon atoms in the alkyl groups is 6–22; or a salt thereof with an alkali metal, an alkaline earth metal, an ammonium or an amine compound.

Other suitable anionic surface active agents are aliphatic, e.g. alkyl, sulphates and phosphates which may be illustrated by the general formulas

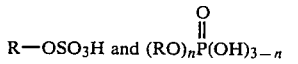

wherein R is a straight or branched, saturated or unsaturated aliphatic group with 10–22 carbon atoms and n is the integer 1 or 2; or a salt thereof with an alkali metal, an alkaline earth metal, an ammonium or an amine compound. As specific examples of alkyl sulphates lauryl sulphate, myristyl sulphate, stearyl sulphate and oleyl sulphate may be mentioned.

Further anionic surface active compounds are ether sulphates and ether phosphates of the general formulas

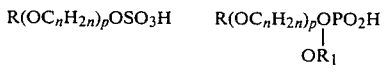

wherein R is a straight or branched, saturated or unsaturated aliphatic group with 8 to 27 carbon atoms, a monoalkyl, dialkyl or trialkyl substituted phenyl group containing a total of 6 to 18 carbon atoms in the alkyl groups, or an alkyl-cycloalkyl group containing a total of 8 to 22 carbon atoms, $(OC_nH_{2n})_p$ is an alkylene glycol chain wherein n denotes the integers 2, 3 and/or 4, p is an integer 1–10, $R_1$ denotes hydrogen or any one of the above defined groups R or $R(OC_nH_{2n})_p$; or a salt thereof or an alkali metal, an alkaline earth metal, an ammonium or an amine compound.

Suitable cationic surface active agents are those which display at least one long hydrophobic chain attached to a tertiary or quaternary nitrogen group. They must be soluble or dispersible in water.

Examples of such cationic surface active agents are quaternary ammonium compounds containing one or two hydrophobic groups with 8–22 carbon atoms according to the general formula:

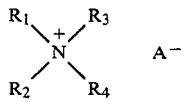

wherein $R_1$ denotes a straight or branched, saturated or unsaturated aliphatic group containing 8–22 carbon atoms or an unsubstituted or substituted phenyl alkyl group containing a total of 7–22 carbon atoms in the phenyl alkyl group, or an alkyl-cycloalkyl group containing a total of 8–22 carbon atoms, $R_3$ and $R_4$ denote independently of each other a methyl, or an ethyl or a hydroxyethyl group and $R_2$ denotes an $R_1$ or $R_3$ group. A is an anion.

Other suitable cationic agents are tertiary ammonium compounds of the general formula:

$$R_1R_2N(R_3)$$

wherein $R_1$, $R_2$ and $R_3$ have the same meaning as in the above formula regarding quaternary ammonium compounds. Particularly suitable ionic surface active agents are those which contain an ionic group at the hydrophobic moiety of the compound, i.e. immediately adjacent to, or incorporated in, the hydrophobic part of the compound, and a free attached nonionic alkylene oxide chain. Such ionic compounds assist in enhancing the steric stability since they contain a water soluble ethylene oxide chain.

Examples of other particularly suitable ionic surface active agents are described by the formula:

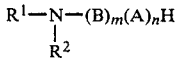

wherein $R^1$ and $R^2$ independently of each other denote an aliphatic group containing 1–24 carbon atoms, or the group:

$$(B)_m(A)_nH$$

wherein B denotes an oxyalkylene group with 3 to 4 carbon atoms, A denotes an oxyethylene group, m is a number 0 to 50 and n is an integer 2–150, preferably 5–100, most preferred 10–90; or a quarternary compound thereof.

The groups $R^1$, $R^2$ and $(B)_m(A)_nH$ must be adjusted to each other so that a surface active agent is obtained.

Other compounds of a closely related type are those represented by the following formula

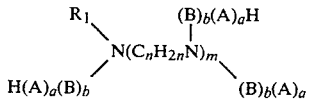

wherein $R_1$ is an aliphatic group having 8–24 carbon atoms or the group $H(A)_a(B)_b$, A is an oxyethylene group, B is an oxyalkylene group containing 3–4 carbon atoms, a is at least 40, preferably 50–150, b is a number from 10 to 25, n is a number from 2 to 6 and m is a number from 1 to 3.

Examples of such compounds are reaction products from alkylenediamines, dialkylenetriamines or trialkylenetetramines to which propylene oxide and/or butylene oxide and ethylene oxide are added so as to reach a molecular weight of about 14000 to 20000 and an ethylene oxide content of about 70 to 80% by weight.

Further suitable compounds are those of the general formula:

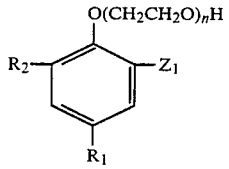

(IX)

wherein $R_1$ and $R_2$ are hydrogen or an alkyl group with 1–22 carbon atoms, provided that the sum of the number of carbon atoms of $R_1$ and $R_2$ is at least 6, and $Z_1$ designates the group $—SO_3H$, $—CH_2N^+HR_3R_4X^-$ or $—CH_2N^+{}^{R}{}_3R_4R_5X^-$, wherein $R_3$, $R_4$ and $R_5$ are alkyl and/or hydroxyalkyl groups with 1–4 carbon atoms and X is an anion, and n is 40–200, preferably 50–150 and most preferred 60–90; or a salt thereof.

In these last-mentioned compounds $R_1$ and $R_2$ usually are hydrogen or a butyl, octyl, nonyl or dodecyl group. These compounds exhibit, in combination with nonionic surface active ethylene oxide adducts, very favourable properties and it is possible to produce an aqueous solid fuel slurry with this combination which displays a very high solids concentration, satisfactory stability and low viscosity.

The most preferred combination is one which as the ionic constituent contains a tertiary nitrogen compound.

The concentration of the surface active agents in the aqueous slurry according to the invention, amounts in total to 0.02–2% by weight, based upon the aqueous slurry. Preferably, the concentration of the surface active compounds according to the invention is 0.05–0.8% by weight of the slurry.

The amount of ionic surface active agent used relative to the amount of nonionic surface active agent is dependent on the extent of particle surface charge. Usually the ionic agent is added in an amount of 0.1–33, preferably 0.5–25, more preferably 2–8% by weight of the total amount of surface active additives.

In addition to the above-mentioned specific surface active compound according to the invention, the carrier liquid may also incorporate other conventional additives, such as antimicrobial agents, antifoaming agents, pH-modifying additives, and conventional stabilizers increasing the effect of the surface active compound according to the invention or producing a further effect.

The addition of conventional stabilizers is especially suitable when the hydrophilic part of the dispersant is relatively short. Examples of conventional stabilizers are protective colloids, such as xanthan gum, cellulose derivatives, such as carboxy methyl cellulose, ethylhydroxyethyl cellulose, hydroxyethyl cellulose, clays, such as attapulgite, sepiolite, bentonite, aluminum hydroxide, silica gel, cellulose suspensions, carbon black, starch and starch derivatives.

If further additives are to be used, over and above the specific surface active compound, the rule is that the conventional stabilizer should be added up to a concentration of at most 1% by weight, preferably at most 0.2% by weight, while the antifoaming agent should be added up to a concentration of at most 0.1% by weight, all based upon the weight of the carrier liquid. The pH-modifying additive which, preferably, is an alkali metal hydroxide, such as sodium hydroxide, is added in such an amount that the pH of the carrier liquid is caused to lie on the alkaline side, for example above pH 10, thereby to eliminate corrosion problems in the transport and storage equipment.

Furthermore, the aqueous carrier liquid according to the invention contains as the major component a solid fuel in the form of a pulverized, carbonaceous material. As has previously been mentioned, the carbonaceous material is selected among bituminous coal, anthracitic coal, sub-bituminous coal, lignitic coal, charcoal and petroleum coke. If one disregards the solids content that is conditioned by the additives, the content of the carrier liquid of pulverized, carbonaceous material may be equated with the solids content of the carrier liquid, i.e. it is 65–90% by weight, preferably 70–80% by weight, based upon the total weight of the carrier liquid. The pulverized carbonaceous material need not be subjected to any treatment to increase its hydrophobicity.

The particle size of the pulverized carbonaceous material plays an important part regarding the stability of the carrier liquid according to this invention. To arrive at an optimal particle size several considerations are required. First of all, impure, solid fuels, such as coal, must be concentrated to eliminate inorganic impurities from the organic material. The particle size must be adapted so that it will permit satisfactory release of the impurities. In the second place, fuel carrier liquids should preferably have a particle size not exceeding 100–250 μm to ensure complete combustion of the fuel particles in the flame. It is also desirable to keep down that fraction of the particles which is greater than 100 μm, thereby to minimize wear of the burner and similar equipment for handling the carrier liquid. In the third place, the particle size distribution must, of course be such that it entails, to the greatest possible extent, a minimum water content, minimum viscosity and maximum stability of the carrier liquid.

Owing to the favourable properties of the specific surface active compound according to the present invention, the last-mentioned requirement concerning the particle size distribution is not as critical as is normally the case in highly concentrated aqueous slurries of solid fuels, and the invention admits of certain fluctuations in the particle size distribution, as is normally the case under commercial production conditions, without detriment to the viscosity or stability of the carrier liquid. More particularly, it has been found that for the present invention the particle size should lie within the range 0.1–350 μm, preferably 1–250 μm. For maximum results, however, the particle size should not exceed about 200 μm.

For some applications, such as the burning of the fuel carrier liquid in a fluidized bed or the injection of the fuel carrier liquid into blast furnaces, the particle size of the pulverized, carbonaceous material is not especially critical, and the fuel carrier liquid may include relatively large particles, without causing any difficulties. However, one should not go beyond a particle size of about 0.5 mm because of the risk of particle sedimentation which may occur if the particles are too large.

The invention has been described above with reference to that aspect thereof which concerns an aqueous carrier liquid of a solid fuel.

The process for producing an aqueous carrier liquid according to the present invention will now be described in connection with a solid fuel in the form of bituminous coal. The basic technology is the same for other solid fuels, such as sub-bituminous, anthracitic and lignitic coal, charcoal and petroleum coke and other solid refinery by-products etc., or combinations thereof, even though these fuel types are not in every respect processed in the same manner. Thus, certain solid fuels do not require the purification step which is described and applied to the coal referred to below, whereas some fuels having high affinity to water (charcoal, lignite etc.) require a surface treatment to increase the hydrophobic characteristics, and in some cases the differences in the mechanical properties of different types of coal necessitate milling equipment which is different from the equipment described below for bituminous coal.

A suitable starting material is bituminous coal that has been crushed to a certain extent and subjected to primary concentration in conventional manner, such that the content of inorganic matter in the coal, exclusive of moisture, has been reduced to about 5–20% by weight. The resulting product is then reduced in conventional manner to a particle size suitable for a first milling step which preferably is a wet-milling operation in a ball or rod mill.

By this first milling step three objects are realized:

1. Milling to a maximum particle size providing for a sufficient release of inorganic impurities in the coal.
2. Milling to a maximum particle size suitable for the contemplated use, i.e. a size which can burn out completely in the reaction zone, for instance a flame.
3. Milling to a particle size distribution suitable for the rheological characteristics of the fuel.

The conditions that must be fulfilled to attain the objects 1 and 2 are laid down on one hand by the mineralogy of the coal and, on the other hand, by the method of application. As has been mentioned before, a particle size of about 0.5 mm should not be exceeded, and normally it does not exceed 350 μm. Usually, it is preferred that the maximum particle size be about 100–200 μm.

Regarding the particle size distribution, it is a well-known fact that the size distribution of a particle aggregation can be optimized in order to minimize the pore number of the particle aggregation, i.e. the volume not taken up by solid matter. The present invention makes no absolute demand for any specific distribution in order to obtain a composition having a low water content, low viscosity and satisfactory stability. Investigations of a number of coal types show that, depending both on the type of the coal and on the milling method, different compositions of particle shapes can be identified in the particle aggregation after the milling operation. This means that there exists for every coal type and for every milling operation, i.e. the milling circuit and the mill types included therein, a given size distribution which gives an optimal water content and viscosity and which can be established by the expert.

What is more, the particle geometries of the composition may affect the rheology and stability. Thus, it is possible to select certain mill types for the mill circuit in order to give a dominant position to, for example, equiaxial grains or discoid and flake-like grains, thereby to influence the final properties of the composition in a manner favourable to each specific application.

It is, however, an important aspect of this invention that the stabilizing and viscosity-reducing chemical additives to produce useful fuels with low water contents are not critically dependent upon specific size distributions. On the other hand, it is propitious to produce, according to known principles, such size distributions as give a maximum content of solid matter in the composition, and further advantages are obtainable by controlling the particle shapes.

The tendency of different mill types to give different particle geometries may be exemplified as follows:

| | |
|---|---|
| Hammer mill: | Dominance of equiaxial particles on milling of bituminous coal. |
| Wet milling in rod mill: | Dominance of irregular pointed and needle-shaped particles upon milling of bituminous coal. |
| Szego mill: (from General Comminution, Inc. Toronto, Canada) | Flat flake-shaped particles upon milling of bituminous coal. |

Some examples of suitable size distributions are the following:

1. Bituminous coal from United Coal Companies, Virginia USA (Widow Kennedy Seam)

| Composition: | |
|---|---|
| Fixed carbon: | 65% |
| Volatile components | 28% |
| Mineral components | 7% |

The following particle size distribution has resulted in finished carrier liquids containing a solid fraction of up to 83.5% (total fraction of solid matter, % by weight of dry matter);

| | | |
|---|---|---|
| Less than | 200 μm | 100% |
| " | 150 μm | 91% |
| " | 100 μm | 78% |
| " | 75 μm | 71% |
| " | 45 μm | 58.5% |
| " | 25 μm | 47% |

2. Bituminous coal from Cape Breton Development Co., Nova Scotia, Canada (Harbour Seam)

| Composition: | |
|---|---|
| Fixed Carbon: | 63.5% |
| Volatile components | 34.0% |
| Mineral components | 2.5% |

The following particle size distribution has resulted in finished carrier liquids containing a solids fraction of up to 78% (% by weight of dry matter):

| | | |
|---|---|---|
| Less than | 200 μm | 100% |
| " | 150 μm | 91% |
| " | 100 μm | 78% |
| " | 75 μm | 71% |
| " | 45 μm | 58.5% |
| " | 25 μm | 47% |

In the most typical case, the first milling step uses wet milling in a ball mill and/or rod mill. This does not preclude the use of other conventional mill types which are known to the expert and can be selected depending upon the characteristic milling properties of each coal type. The mill circuit which comprises one or several mills and classification equipment, is designed in such a manner that the conditions 1–3 as previously mentioned are fulfilled. In order to attain a suitable size distribution the milling circuit must be designed in a special manner since it is only in exceptional cases that the passage through one mill or several mills of the same type results in a suitable distribution. In most cases, the best results are obtained with a mill circuit based upon a division into different fractions, whereby the natural tendency of the coal to give a specific size distribution can be counteracted.

One of the difficulties encountered in these milling operations resides in that their particle size distribution gives a concentration of particles in the intermediate range so that the distribution will be too narrow, which means that the volume concentration of solid matter will be insufficient. This can be remedied by designing the mill circuit for instance in the following manner.

Coal is introduced, together with water, into a ball mill for wet milling. The milling product which is coarser than the final product from the first milling step, is conducted to a sieve which allows material whose particle size is below the desired maximum size to pass. Coarse material which does not pass through the sieve, is conducted to a second ball mill where size reduction is effected to increase the fine fraction of the final milling product. A hydrocyclone disposed after the ball mill separates the milling product from the ball mill into a fine and a coarse fraction, and the coarser material is recycled to the ball mill. The fine fraction is recycled to the sieve, whereby the final milling product is obtained which has a maximum size determined by the sieve and which contains both coarser and finer particles within the desired range.

The above example is far from being the only conceivable solution of a milling circuit for the first milling step and merely is intended to show how a suitable milling product can be obtained by using conventional milling technology. A person skilled in the art and familiar with the above-described principles which are valid for particle sizes and particle size distributions, as well as the properties of the type of coal at his disposal, is capable of testing and constructing operational mill circuits based upon known mill types.

The milling product from the first milling step, which is suspended in an aqueous phase, may then, if necessary, be conducted to a separation process where inorganic components are separated from substantially organic solid fuel components. The separation process conventionally consists of froth flotation in one or more steps, implying either (i) that organic components are raised by utilizing their natural flotability or, should this be insufficient, by means of a flotation reagent, such as kerosene or fuel oil which enhance the flotability. At the same time, pyrite can be passivated by adding for example $FeCl_3$, calcium ions or other additives reducing the affinity of the pyrite to air bubbles. A purification carried out in this manner has been found to give, depending upon the type of coal, ash contents of 1–5% in coal concentrates; or (ii) that the flotation is conducted inversely such that the coal is passivated and inorganic components are floated off by means of hydrophobating additives which selectively render inorganic additives hydrophobic.

Flotation may also be carried out in part steps between intermediate milling steps for intermediate products to release further inorganic substance and increase the purity of the final concentrate.

Besides flotation, the purification process may also include other physical separation processes, such as high-intensity magnetic separation and other known purification processes that can be used for fine particles in the wet phase.

Flotation may result in certain changes in the particle size distribution, as compared with the milling product from the first milling step. A second milling step for a given part flow of concentrate particles must therefore be carried out in certain cases, primarily in order to compensate for the loss of the finest particles of the particle aggregation.

The choice of the mill type will depend upon the necessity of milling a given part quantity of material, usually 5–25% of the total quantity, to a given meximum particle size, and presents no difficulties to the expert who knows the desired final particle size distribution.

The concentrate from the first milling step, or from the second milling step, if any, has a solids content of about 20–50% by weight, usually about 25% by weight. The concentrate must therefore be dewatered to a water content which preferably is one or two percentage units lower than the water content of the final composition since the additives used are preferably added in the form of aqueous solutions.

Dewatering is normally conducted in two steps, i.e. thickening followed by filtering in either a vacuum filter or a filter press. In some instances, a flocculant may be present in the thickener, provided that it does not interact with the additives for the carrier liquid composition according to the invention.

When extremely low water contents are desired, for instance below 20% by weight, dewatering may be completed by admixing a dry, milled and sufficiently pure coal product.

After dewatering, there is added to the resulting filter cake one or more additives including at least the surface active compound according to the invention. As has been mentioned above, the additive is supplied in the form of an aqueous solution admixed to the filter cake. The mixing process and equipment are designed in such a manner that the mixture will be as homogeneous as possible, and such that the particle surfaces are covered as completely as possible by the additive.

After dewatering has been effected and the additive has been supplied, the composition is pumpable and is pumped to storage tanks for further transport to the user.

To further illustrate the invention the following Examples are given of slurries useful as carrier liquids according to the invention for coarse grains of carbonaceous material having a particle size of up to 25 mm. In the Examples, the pulverized carbonaceous material in the carrier liquid slurries consisted of bituminous coal from the eastern USA, more particularly from United Coal Companies, Virginia, USA (Widow Kennedy Seam). The composition of this coal has been specified before. After wet milling in a rod mill and ball mill, particles were obtained which had a particle distribution that has also been mentioned before. The specific surface area of the coal powder was 4.5 $m^2/g$, determined according to the BET method by nitrogen adsorption.

EXAMPLE 1

A slurry was prepared from 68.0 parts by weight of coal powder 0.35 parts by weight of a 75/25 mixture of surfactants comprising ethoxylated (100 EO) dinonylphenol and quaternary, ethoxylated coconut oil amine 31.65 parts by weight of water.

For the production of the slurry, the dry coal powder was mixed with the water, whereupon the solution of the surfactant mixture (0.70% solids content) was added to provide a slurry having a total solids content of 68%.

Rheological data for the slurry were determined by means of a Contraves Reomat 115 viscosimeter. The result obtained during 2.21 minutes of acceleration from 0 to 450 $s^{-1}$, 5.0 minutes at 450 $s^{-1}$ and deceleration during 2.21 minutes is shown in Table 1.

TABLE 1

| Shear rate ($s^{-1}$) | Apparent viscosity (cP) | |
|---|---|---|
| | Accelerated | Decelerated |
| 32.6 | 117 | 55 |
| 100 | 118 | 63 |
| 200 | 119 | 68 |
| 300 | 120 | 72 |
| 450 | 112 | 75 |

EXAMPLE 2

A slurry was prepared from:

81.0 parts by weight of coal 0.77 parts by weight of a 75/25 mixture of surfactants according to example 1

18.23 parts by weight of water.

To prepare the slurry, one proceeded in the same manner as in Example 1. The rheological characteristics will appear from Table 2.

TABLE 2

| Shear rate ($s^{-1}$) | Apparent viscosity (cP) | |
|---|---|---|
| | Accelerated | Decelerated |
| 32.6 | 1240 | 810 |
| 100 | 1200 | 780 |
| 200 | 1280 | 800 |
| 300 | 1410 | 900 |
| 450 | 1600 | 1090 |

Slurries prepared in accordance with Example 1 and Example 2, above, were tested in actual practice by static and vibratory storage and transport by ship for a period of 4 weeks. No separation of the water from the solids could be observed.

EXAMPLES 4–12

The amounts of the respective additives, as stated in Table 1, were dissolved in 30 ml of water having a hardness of 1.2° dH, whereupon 70 g of coal powder were added and stirred with a glass rod for 1 minute. The appearance of the suspension was then judged according to a scale from 1 to 4 where 1 = Dry ("solid")

2 = Viscous. Unsatisfactory pumpability

3 = Liquid. Suitable for pumping

4 = Easy flowing. Excellent pumpability.

The suspension was kept for 48 hours in a sealed beaker and then inspected especially for sedimentation stability.

In Table 1, Examples 4–12 concern carrier liquids in accordance with the present invention whereas tests A–G are comparisons. The Examples clearly show the effect that is obtained if the ethylene oxide chain contains, in accordance with the present invention, the defined number of repeating units.

TABLE 1

| | Additive | Amount of additive (g) | Appearance after 48 hours (points) |
|---|---|---|---|
| Example | | | |
| 4 | Nonylphenol + 40 EO | 0.3 | 3 |
| 5 | Nonylphenol + 50 EO | 0.3 | 3 |
| 6 | Nonylphenol + 70 EO | 0.3 | 4 |
| 7 | Nonylphenol + 90 EO | 0.3 | 4 |
| 8 | Dinonylphenol + 70 EO | 0.3 | 4 |
| 9 | Dinonylphenol + 80 EO | 0.3 | 4 |
| 10 | Dinonylphenol + 100 EO | 0.3 | 4 |
| 11 | Dinonylphenol + 100 EO | 0.1 | 3 |
| 12 | Cetyl/stearyl + 80 EO | 0.3 | 4 |
| Comparison | | | |
| A | None | 0 | 1 |
| B | Nonylphenol + 8 PO + 20 EO | 0.3 | 2 |
| C | Dinonylphenol + 16 PO + 20 EO | 0.3 | 2 |
| D | Nonylphenol + 100 EO | 0.3 | 2 |
| E | Nonylphenol + 120 EO | 0.3 | 2 |
| F | Nonylphenol + 150 EO | 0.3 | 1 |
| G | Dinonylphenol + 150 EO | 0.3 | 2 |

Note:
In Table 1 EO denotes "ethyleneoxy" and PO denotes "propyleneoxy".

EXAMPLES 13–17

Slurries were prepared from bituminous high volatile coal (ex Cape Breton Development Corporation, Sydney, Nova Scotia) milled to minus 200 micron size, water and dinonylphenol ethylene oxide adduct in accordance with Table 2.

Coal: 71.6% by weight
Water: 28.0% by weight
Additive: 0.4% by weight

The viscosities of the slurries were measured at 451 reciprocal seconds shear rate in a Contrave Rheomat 115 viscometer. The results were evaluated and graded on a scale of 1 to 4, where:

1. denotes a viscosity of over 600 centipoise
2. denotes viscosities between 500 and 600 centripoise
3. denotes viscosities between 400 and 500 centipoise
4. denotes viscosities below 400 centipoise.

TABLE 2

| Ethoxylated dinonylphenol | | |
|---|---|---|
| Number of repeating ethyleneoxy units | Viscosity at 451 ($S^{-1}$) | Evaluation (1–4) |
| H 32 | 520 | 2 |
| 13 40 | 428 | 3 |
| 14 56 | 364 | 4 |
| 15 72 | 312 | 4 |
| 16 80 | 332 | 4 |
| 17 96 | 338 | 4 |
| I 150 | 780 | 1 |

Viscosity figures over 50 are unsatisfactory.

The following examples illustrate the pumpable slurry according to the present invention.

EXAMPLE 18

Various amounts of a bituminous East Canadian coal from Harbour Seam, Cape Breton Development Corp., Sydney N.S.,) with a particle size larger than 3 and smaller than 10 mm was added under agitation to a coal water slurry carrier liquid essentially in accordance with Example 16. Sieve analysis of the original coal water slurry which was produced from the same type of coal showed that:

| |
|---|
| 100 weight % of the particles passed a sieve with 250 um openings |
| 99.9 weight % of the particles passed a sieve with 200 um openings |
| 98.7 weight % of the particles passed a sieve with 160 um openings |
| 91.9 weight % of the particles passed a sieve with 125 um openings |
| 78.8 weight % of the particles passed a sieve with 90 um openings |
| 70.1 weight % of the particles passed a sieve with 71 um openings |
| 65.1 weight % of the particles passed a sieve with 63 um openings |
| 54.0 weight % of the particles passed a sieve with 40 um openings |

The viscosities of the slurries at 25° C. were assessed after 1 minute rotational time at 6 rpm in a Brookfield LVT viscosimeter using Spindle 3. The results are shown in the Table below:

| Weight % coarse particles in the slurry (3–10 mm) | Weight % moisture in the slurry | The viscosity of the slurry relative the viscosity of the slurry without coarse particles added. |
|---|---|---|
| 0 | 29.2 | 1.00 |
| 5 | 27.8 | 1.05 |
| 10 | 26.4 | 1.07 |
| 15 | 25.0 | 1.09 |
| 17.5 | 24.4 | 1.09 |
| 20 | 23.7 | 1.24 |
| 25 | 22.3 | 1.38 |
| 30 | 20.9 | 1.56 |

The original coal-water slurry carrier liquid, i.e. without coarse particles, was evaporated to various degrees and its viscosity was measured with the Brookfield viscosimeter at 25° C. The results are shown in the Table below:

| Weight % moisture in the slurry | The viscosity of the slurry relative to the viscosity of the non-evaporated slurry |
|---|---|
| 28.6 | 1.18 |
| 27.4 | 1.56 |
| 26.6 | 2.24 |
| 24.9 | 4.02 |

From the Table it can be seen that the relative viscosity was considerably higher at the same water content as compared to the slurries with the same moisture content containing coarse particles.

An attempt was made to produce a slurry as concentrated as possible from the same coal particle consist and with the same additives as the one the original slurry was produced from. No pourable slurries could be produced with a water below 23–24 weight %.

Experiments also showed that it was impossible to produce a slurry containing only coarse particles as the dispersed phase with the same water content as the original carrier liquid without coarse particles added.

EXAMPLE 19

Various amounts of coarse coal particles (same as in Example 18) were added to a coal-water slurry carrier liquid similar to that in Example 18. These slurries were transferred to a tank to the bottom of which a 3.80 m long vertical pipe with an inner diameter of 0.05 m was attached. The pipe was equipped with a valve at its lower end. The time required to empty 32 $dm^3$ of the various slurries was assessed. The results are shown in the Table below.

| Weight % coarse particles (3–10 mm) | Weight % moisture in the slurry | Time needed to draw off 32 $dm^3$ slurry (sec.) |
|---|---|---|
| 0 | 30.1 | 20 |
| 6 | 28.4 | 24 |
| 8 | 27.8 | 26 |
| 10 | 27.2 | 29 |
| 12 | 26.7 | 32 |
| 14 | 26.1 | 35 |
| 16 | 25.5 | 40 |
| 18 | 25.0 | 44 |
| 20 | 24.4 | 49 |

From the Table it can be seen that the slurry according to the present invention including coarse coal particles had a satisfactory pumpability. However, the time needed to transfer an evaporated coal-water slurry carrier liquid through the pipe was considerably longer at the moisture contents given in the Table above for slurries incorporating coarse particles.

What we claim and desire to secure by Letters Patent is:

1. A pumpable aqueous slurry of a solid fuel in the form of a pulverized, carbonaceous material, characterized in that the aqueous slurry consists essentially of up to about forty percent by weight, based upon the total weight of the aqueous slurry, of coarse grains of the carbonaceous material having a particle size of at least about 1 mm up to 25 mm, said grains being suspended in a carrier liquid having a solids content of 65–90% by weight and consisting essentially of water, pulverized carbonaceous material with a particle size of at most about 0.5 mm, and 0.02–2% by weight of at least one additive which incorporates a water-soluble, surface active compound which is an alkylene oxide adduct having a hydrophobic part and a hydrophilic part, said hydrophilic part consisting essentially of at least one polyalkylene oxide chain having a length of 40–200 alkylene oxide units.

2. A pumpable aqueous slurry as claimed in claim 1, characterized in that it contains 20–40% of the coarse-grained carbonaceous material, based upon the total weight of the aqueous slurry.

3. A pumpable aqueous slurry as claimed in claim 1, characterized in that said alkylene oxide adduct is non-ionic and that the surface active additive of the carrier liquid further includes an ionic surface active agent.

4. A pumpable aqueous slurry as claimed in claim one, characterized in that the carrier liquid contains 0.05–0.8% by weight of a water-soluble surface active compound.

5. A pumpable aqueous slurry as claimed in claim one, characterized in that the carrier liquid contains, in addition to the water-soluble surface active compound, a further additive which is selected from stabilizers, antifoaming agents, pH-modifying additives, and anti-microbial agents.

6. A process for the production of a pumpable aqueous slurry of a solid fuel in the form of a pulverized, carbonaceous material, characterized by preparing a carrier liquid having a solids content of 65–90% by weight and consisting essentially of water, pulverized carbonaceous material with a particle size of at most about 0.5 mm, and 0.02–2% by weight of at least one additive which incorporates a water-soluble, surface active compound which is an alkylene oxide adduct having a hydrophobic part and a hydrophilic part, said hydrophilic part consisting essentially of at least one polyalkylene oxide chain having a length of at least 40 units, and adding to the carrier liquid thus prepared coarse grains of the carbonaceous material having a particle size of at least about 1 mm up to about 25 mm.

7. A process as claimed in claim 6, characterized in that the carrier liquid is prepared by a process incorporating the following steps:

(a) wet-milling a carbonaceous starting material together with water at a solids content of 20–50% by weight in at least one milling step;

(b) separating, if necessary, inorganic material of the carbonaceous starting material from the carbonaceous material of said starting material;

(c) dewatering the carbonaceous material to a solids content which is substantially equal to the solids content of the final carrier liquid;

(d) adding the additive of the carrier liquid and distributing said additive in the dewatered carbonaceous material.

8. A process as claimed in claim 6 or 7, characterized by adding to the carrier liquid 20–40%, based upon the total weight of the aqueous slurry, of the coarse-grained, carbonaceous material.

9. A process of claim 8 wherein the number of alkylene oxide units is 50–200.

* * * * *

UNITED STATES PATENT AND TRADEMARK OFFICE

CERTIFICATE OF CORRECTION

PATENT NO. : 4,496,367

DATED : January 29, 1985

INVENTOR(S) : Mait M. Mathiesen, Lars I. Gillberg, Karl M. E. Hellsten and Gunvor B. T. Karlsson It is certified that error appears in the above-identified patent and that said Letters Patent is hereby corrected as shown below:

Title Page, [56] References Cited, FOREIGN PATENT DOCUMENTS, last line; "WO83/0005-" and "00 2/1983 PCT Int'l Appl. ." should all be on the same line because it is all the same document Col. 9, line 33; "$-CH_2N{+}HR_3R_4X-$" should read -- $-CH_2\overset{+}{N}HR_3R_4X-$ --

Col. 9, line 34; "$-CH_2N{+}R_3R_4R_5X-$" should read -- $CH_2\overset{+}{N}R_3R_4R_5X-$ --

Col. 14, lines 32 and 33; "meximum" should read -- maximum --

Col. 16, line 20; "EXAMPLES 4-12" should read -- EXAMPLES 3-11 --

Col. 16, line 23; "Table 1," should read -- Table 3, --

Col. 16, line 35; "Table 1," should read -- Table 3, --

Col. 16, line 35; "Examples 4-12" should read -- Examples 3-11 --

Col. 16, line 37; "A-G" should read -- A-C --

Col. 16, approximately line 41, the table on the bottom; "TABLE 1" should read -- TABLE 3 --

Col. 16, in the bottom table, first column under "Example" renumber the examples "4, 5, 6, 7, 8, 9, 10, 11 and 12" to -- 3, 4, 5, 6, 7, 8, 9, 10 and 11 -- respectively Col. 16, in the bottom table, first column under "Comparison" delete the last four lines (D, E, F and G - those four entire lines of the table)

Col. 16, line 65; "EXAMPLES 13-17" should read -- EXAMPLES 12-16 --

Col. 17, line 2; "Table 2." should read -- Table 4. --

UNITED STATES PATENT AND TRADEMARK OFFICE

CERTIFICATE OF CORRECTION

PATENT NO. : 4,496,367

DATED : January 29, 1985

INVENTOR(S) : Mait M. Mathiesen, Lars I. Gillberg, Karl M. E. Hellsten and Gunvor B. T. Karlsson It is certified that error appears in the above-identified patent and that said Letters Patent is hereby corrected as shown below:

Col. 16, in the footnote of the bottom table; "Table 1" should read --Table 3--
Col. 17, line 11; "centripoise" should read -- centipoise --
Col. 17, line 14, the first table; "TABLE 2" should read -- TABLE 4 --
Col. 17, approximately line 18, in the first table, (line 1 of that table), column 1 of the table; change "H" to -- D --
Col. 17, approximately line 18, in the first table, (line 1 of that table) insert between column 1 (D 32) and column 2 (520) the word --(comparative)--
Col. 17, in the first table, lines 2, 3, 4, 5 and 6 of that table, column 1; change the numbers "13, 14, 15, 16 and 17" to read -- 12, 13, 14, 15 and 16 -- respectively
Col. 17, in the first table, last line of table; delete the whole line "I 150 780 1"
Col. 17, line 25; "50" should read -- 500 --
Col. 17, line 29; "EXAMPLE 18" should read -- EXAMPLE 17 --
Col. 17, line 35; "Example 16" should read -- Example 15 --
Col. 18, line 22; after "water" insert -- content --

Col. 18, line 28; "EXAMPLE 19" should read -- EXAMPLE 18 --
Col. 18, line 31; "Example 18)" should read -- Example 17) --
Col. 18, line 32; "Example 18." should read -- Example 17. --
Col. 19, lines 19 and 23; "one" should read -- 1 --

Signed and Sealed this

*Seventh* Day of *January 1986*

[SEAL]

*Attest:*

DONALD J. QUIGG

*Attesting Officer* *Commissioner of Patents and Trademarks*